US005213428A

United States Patent [19]

Salman

[11] Patent Number: 5,213,428

[45] Date of Patent: May 25, 1993

[54] BIODEGRADABLE TOOTHBRUSH

[75] Inventor: Naser Salman, Gaithersburg, Md.

[73] Assignee: Elisabetta Molari, Cesena, Italy

[21] Appl. No.: 878,550

[22] Filed: May 5, 1992

[51] Int. Cl.[5] ..... A46B 5/04

[52] U.S. Cl. ..... 401/7; 15/227; 15/167.1

[58] Field of Search ..... 401/6-8; 132/308, 309; 15/227, 167.1

[56] References Cited

U.S. PATENT DOCUMENTS

| | | | |
|---|---|---|---|
| D. 283,761 | 5/1986 | Chen . | |
| 463,309 | 11/1891 | Schulze . | |
| 1,811,833 | 6/1931 | Simon | 15/167.1 X |
| 1,894,413 | 1/1933 | Nenning et al. | 401/7 X |
| 1,947,720 | 2/1934 | Laub | 401/7 |
| 2,075,681 | 3/1937 | Welker | 401/7 |
| 2,077,540 | 4/1937 | Welker | 15/227 X |
| 2,966,691 | 11/1958 | Cameron . | |
| 3,902,509 | 9/1975 | Tundermann et al. . | |
| 3,934,299 | 1/1976 | Regester . | |
| 4,251,897 | 2/1981 | Alam | 15/227 X |
| 4,292,705 | 10/1981 | Stouffer | 132/308 X |
| 4,335,731 | 6/1982 | Bora, Jr. . | |
| 4,432,114 | 2/1984 | Goudsmit | 15/167.1 X |
| 4,617,694 | 10/1986 | Bori . | |
| 4,875,247 | 10/1989 | Berg . | |

*Primary Examiner*—Danton D. DeMille

*Attorney, Agent, or Firm*—Jacobson, Price, Holman & Stern

[57] ABSTRACT

A disposable toothbrush formed of a biodegradable material such as biodegradable plastic. The toothbrush would fit, preferably, over the index finger of a user. By using the index finger, it is easy to reach any part of the teeth by locating the toothbrush so as to apply a brushing action to the upper and lower teeth, with the toothbrush located on the outside or inside of the index finger. A toothbrush cap provides an opening for receipt of an index finger of a user. On a flattened portion of the toothbrush cap, are defined two to four rows of short bristles, preferably 3/16 inches in height. These bristles may be formed integrally with the toothbrush cap or include bristles imbedded in the cap. These bristles are impregnated with dehydrated toothpaste which bonds with the bristles to form a defined layer on top of the bristles. Upon contact with water, the impregnated toothpaste would hydrolyze to aid in brushing of the teeth for a single use. Upon completion of brushing, the toothbrush would be disposed of in its entirety.

11 Claims, 1 Drawing Sheet

BIODEGRADABLE TOOTHBRUSH

FIELD OF THE INVENTION

This invention relates to a disposable, biodegradable toothbrush which is placed over the index finger of a user and includes a series of short bristles impregnated with dehydrated toothpaste and which includes accessory items stored on a periphery of the toothbrush, on a side of the toothbrush opposite to that of the bristles.

BACKGROUND OF THE INVENTION

There have been various attempts to provide an inexpensive, finger applied toothbrush device. Some of these prior attempts are as follows:

U.S. Pat. No. 463,309 to Schulze discloses a tooth cleaner composed of a piece of textile fabric impregnated with a tooth powder.

U.S. Pat. No. 2,966,691 to Cameron discloses a tooth cleaner formed of paper and elastic threads to cause the paper to contract and snugly fit around a finger of a user. Upon wetting the paper, the paper is permitted to shrink and firmly grip the fingertip of a user, having a puckered or pebbled configuration. A dentifrice is incorporated in the paper itself to produce an additional cleansing effect when the paper is wet and the dentifrice becomes active.

U.S. Pat. No. 3,902,509 to Tundermann et al. discloses a disposable device for cleaning teeth formed of a high wet strength material which is shaped and sealed in the form of a pocket or flat thimble. Adhered to the outer surface of the device is encapsulated polishing agent.

U.S. Pat. No. 3,934,299 to Regester discloses a tooth cleaning device adapted to be worn on the finger for cleaning the teeth, having an outer surface provided with a fabric texture and the fabric impregnated with a dentifrice material.

U.S. Pat. No. 4,335,731 to Bora, Jr., discloses a device for oral hygiene care composed of a flexible, soft honeycomb sheet. Bristles of the sheet extend outward from the exposed surface of the sheet. The sheet is secured over the finger to clean the user's gums and teeth. A dentifrice is impregnated in the sheet.

U.S. Pat. No. 4,617,694 to Bori discloses a finger-mounted device for cleaning teeth having pick means for cleaning between the teeth, a non-slip finger engaging means, and means for providing a length of dental floss.

U.S. Pat. No. 4,875,247 to Berg discloses a disposable tooth cleaning and polishing apparatus including a sheet of thin, flexible material such as paper cloth or synthetic foam material which also may be formed and contoured.

SUMMARY OF THE INVENTION

It is an object of the present invention to provide a toothbrush improved over the noted prior toothbrushes.

By the present invention, a versatile toothbrush enables people to have the availability of a toothbrush at any time and at any place without the need to carry any of the standard, more common toothbrushes. It would not be necessary to separately carry a tube of toothpaste or other dental accessories such as toothpick, dental floss, mouth medication and/or mouth freshener.

The toothbrush of the present invention is disposable and entirely formed of a biodegradable material such as biodegradable plastic. The toothbrush would fit, preferably, over the index finger of a user. By using the index finger, it is easy to reach any part of the teeth by locating the brush so as to apply a brushing action to the upper and lower teeth, with the toothbrush positioned to be located on the outside or inside of the index finger.

Moreover, by using the index finger, one can easily feel and verify whether or not the furthest portion of the teeth located at the back of the mouth have been brushed. The index finger provides a direct and instantaneous communication between finger nerve tissues of the sensory function which communicate with the brain to sense and ascertain complete and thorough brushing. Further, the index finger can be curved to all appropriate angles required for brushing of the teeth. It therefore, would no longer be necessary to carry a conventional toothbrush when travelling away from home. The present invention is ideally suited for hospitals, hotels, camping, air travel, etc., where a disposable toothbrush is necessary and not presently available.

It is also important that the present invention be made available to the elderly and sick, especially those with arthritis, Parkinson's disease and/or other forms of disease, where the age or sickness of the individuals makes it difficult for them to brush their teeth, due to a lack of ability to grab a utensil. Presently, this segment of society depends on others to brush their teeth and maintain appropriate dental hygiene. However, by the present invention, locating of the inventive toothbrush on the index finger of an individual enables that individual to maintain proper dental hygiene, thereby increasing their self-esteem and decreasing their susceptibility to disease and infections. Such disease or infections usually attribute directly to the deterioration of their already weakened state and thereby would improve the general state of their health.

Economically, the present invention allows a large portion of the population improved dental hygiene maintenance. For old or sick individuals, the savings produced by a reduction of disease and infection caused by an availability of a usable toothbrush, would produce large savings in their annual budgets attributed to health needs. Therefore, this invention would enable society and individual countries to provide a better quality of life for their inhabitants. Further, all age groups would benefit from the use of the present invention by contributing to the ease within which teeth could be brushed and thereby improve the dental hygiene of an increased cross-section of society.

By the toothbrush of the invention a cap provides an opening for receipt of an index finger of a user. On a flattened portion of the toothbrush cap, are defined two to four rows of short bristles, preferably 3/16 inches in height. These bristles may be formed integrally with the toothbrush cap o include bristles imbedded in the cap. These bristles are impregnated with dehydrated toothpaste which bonds with the bristles to form a defined layer on top of the bristles. Upon contact with water, the impregnated toothpaste would hydrolyze to aid in brushing of the teeth for a single use. Upon completion of brushing, the toothbrush would be disposed of in its entirety.

Located on an opposite side of the toothbrush cap from the bristles is a groove or a hole for mating with a capsule, including any one of different oral hygiene products. For example, a capsule could include 1 to 2 feet of dental floss, breath spray, a sterilized toothpick or oral medication. It is also considered part of the present invention that these elements sealed in capsules may also be sealed in voids formed in the toothbrush cap so that upon gaining entry into the sealed voids of the toothbrush cap, access would then be obtained to dental floss, toothpick, breath spray, etc.

All of the materials used for the invention would be disposable, biodegradable material. Optionally, the tip of the toothbrush cap could be open to allow the tip of the finger to protrude through the toothbrush cap. All edges are rounded to prevent the possibility of any cuts being caused in the mouth during brushing. The toothbrush would be sterile and may be sealed within a biodegradable plastic enclosure for distribution purposes.

Typical measurements of the overall toothbrush would be approximately ¾ inch by 1½ inches. The bristle area may be as small as ¼ inch wide by 7/8 inch long.

It is therefore an object of the present invention to provide a disposable, biodegradable toothbrush cap which fits over a finger of the user for brushing of the teeth with impregnated toothpaste which hydrolyzes upon contact with water.

It is another object of the present invention to provide a disposable, biodegradable toothbrush cap which fits over a finger of the user for brushing of the teeth with impregnated toothpaste which hydrolyzes upon contact with water with the bristles being very short and projecting from one side of the toothbrush cap.

It is yet another object of the present invention to provide a disposable, biodegradable toothbrush cap which fits over a finger of the user for brushing of the teeth with impregnated toothpaste which hydrolyzes upon contact with water with the bristles being very short and projecting from one side of the toothbrush cap, with dental hygiene accessories stored inside the cap, and in or on the side wall of the cap on an opposite side of the cap from the bristles.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
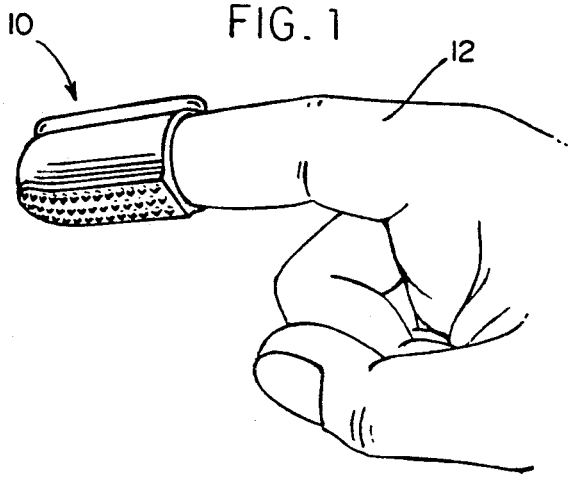
FIG. 1 illustrates the disposable biodegradable toothbrush of the present invention located on the index finger of a user.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

Figure 2:
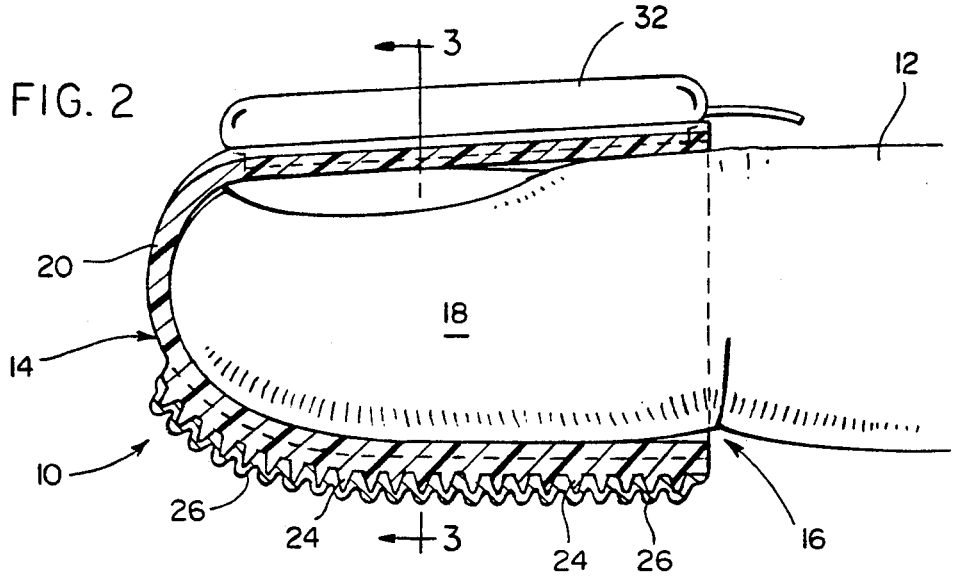
FIG. 2 is a longitudinal sectional view of the toothbrush cap as applied to the finger of a user.
Figure 2:
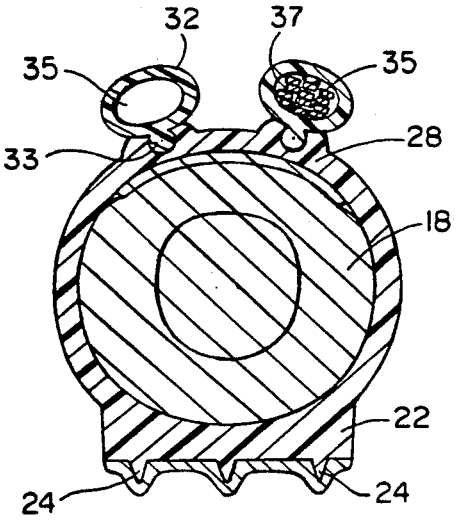

With reference to the drawings, in general, and to FIGS. 1 and 2, in particular, a disposable biodegradable toothbrush embodying the teachings of the subject invention is generally designated as 10. With reference to its orientation in FIG. 1, the toothbrush 10 is shown located on an index finger 12 of a user at the tip 18 of the index finger.

In FIG. 2, the toothbrush is shown as including a cap 14 on a finger 12, having an opening 16 into which the tip 18 of the index finger 12 is inserted. End 20 of the cap 14 may optionally be open so that the tip 18 of the index finger passes through the cap.

Figure 3:
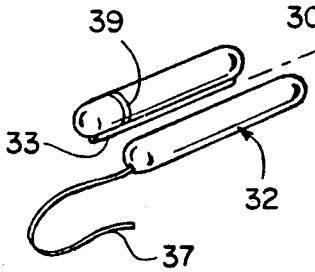
FIG. 3 is a sectional view taken along line 3—3 of FIG. 2.

On one side 22 of the cap, an shown in FIG. 3, is located a relatively flat portion from which projects bristles 24, which in the embodiment shown includes three rows of bristles. It is also possible that two or four rows of bristles be included on the side 22 of the cap.

The bristles 24 are shown as being formed integrally with the cap. Optionally, the bristles may be formed from rigid plastic embedded in the cap 14.

The bristles project from the outermost surface of side 22 for a distance of approximately 3/16 of an inch. Located on top of the bristles and the flat side 22 of the cap 14 is a dehydrated toothpaste layer 26. This layer is hydrolyzed upon contact with water to provide a toothpaste aid during brushing.

Figure 4:
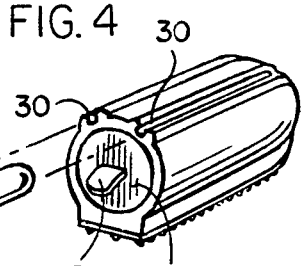
FIG. 4 is an exploded view of two capsules includes dental accessories which are separated from the toothbrush cap.

Located on an opposite side 28 of the cap 14, from the side 22, are at least one groove 30, as shown in FIG. 4, for receipt of a dental hygiene accessory capsule 32. The capsule is made of a disposable, biodegradable material such as biodegradable plastic. In FIG. 4, two grooves 30 are shown for receipt of two capsules 32 which include complementary shaped projections 33 for slidingly mounting the capsules 32 on the cap 14.

Figure 5:
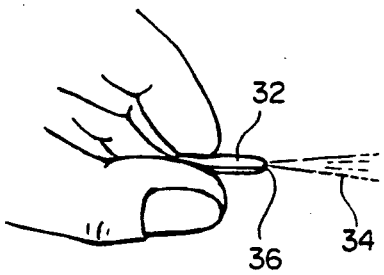
FIG. 5 illustrates application of a mouthwash spray from a capsule for a dental hygiene product.

Capsule 32 may include a length of dental floss, a toothpick, mouthwash spray, oral medicine, or other dental hygiene products. The capsules 32 include a void 35 so that upon gaining access of the void by removing one end of the capsule as shown in FIG. 5, upon application of pressure to the capsule, a liquid, such as a breath spray 34, or oral medication, may be released under pressure from the open end 36 of the capsule 32. Similarly, access to the interior of the capsule could be obtained, possibly by biting the end of the capsule to obtain access to dental floss 37 or other products sealed within the void 35 of the capsule. Alternately, a groove 39 is formed in side walls of the capsule so that the capsule is broken easily.

In addition a capsule 40 for holding mouthwash may be located in the opening formed by the cap for the receipt of a finger tip 18. Handle projection 42 facilitates removal of capsule 40 for access of finger tip 18 into the cap 14.

Optionally, the dental hygiene accessory products may be located in voids formed directly in side 28 of the cap 14 for access to the accessories either before or after brushing of the teeth with the bristles 24. For brushing, the fingertip 18 is inserted in opening 16, the layer 26 wetted, and the finger 12 moved along the teeth with application of slight pressure.

Improved dental hygiene would be more readily obtainable by a wider segment of the population through distribution of disposable, biodegradable toothbrushes as embodied by the invention. Further, those presently unable to brush their own teeth would have a better chance of brushing their teeth by locating the subject invention upon a finger of the hand and using their finger as the motive force as well as the applicator for ensuring complete and improved brushing of their teeth.

The advantages obtained by the present invention are numerous. For example, one size toothbrush can fit men, women and children. A savings on water consumption is obtained by the invention by reduced rinsing over that required for a permanent-type toothbrush since this toothbrush is merely disposed of. Further, chemicals used for keeping the toothpaste moist for use on permanent-type toothbrushes are no longer needed. Bathroom sink mess from excess toothpaste is avoided by premeasured toothpaste impregnated on the disposable toothbrush. In addition, toothbrush holders are no longer necessary.

Having described the invention, many modifications thereto will become apparent to those skilled in the art to which it pertains without deviation from the spirit of the invention as defined by the scope of the appended claims.

I claim:

1. A disposable toothbrush comprising:

a cap including an opening for receipt of a fingertip, a flat surface located on one side of said cap having bristles projecting therefrom for brushing of teeth, a layer of dehydrated toothpaste being located on said bristles, and at least one dental hygiene accessory located on a side of said cap opposite to said one side, said at least one dental hygiene accessory being located within a capsule slidably mounted on said cap.

2. A disposable toothbrush as claimed in claim 1, wherein said capsule surrounds said at least one dental hygiene accessory.

3. A disposable toothbrush as claimed in claim 1, wherein said cap is biodegradable.

4. A disposable toothbrush as claimed in claim 1, wherein said bristles are integral with said cap.

5. A disposable toothbrush as claimed in claim 1, wherein said cap includes a groove for receipt of a projection extending from said capsule.

6. A disposable toothbrush as claimed in claim 1, wherein said capsule includes a void for storing of said dental hygiene accessory.

7. A disposable toothbrush comprising:

a cap including an opening for receipt of a fingertip, a flat surface defined by one side of said cap and having bristles projecting therefrom for brushing of teeth, a layer of dehydrated toothpaste embedded on said bristles, and a dental hygiene accessory located on said cap, said dental hygiene accessory being located on a side of said cap opposite to said one side and within a capsule slidably mounted on said cap.

8. A disposable toothbrush as claimed in claim 7, wherein said dental hygiene accessory is a liquid located in said capsule housed within said cap.

9. A disposable toothbrush as claimed in claim 8, wherein said liquid is released upon opening of a capsule having stored said liquid.

10. A disposable toothbrush as claimed in claim 9, wherein said cap includes a groove for receipt of a projection extending from said capsule.

11. A disposable toothbrush as claimed in claim 7, wherein said cap is biodegradable.

* * * * *